US009814270B2

(12) United States Patent
Montgomery

(10) Patent No.: US 9,814,270 B2
(45) Date of Patent: Nov. 14, 2017

(54) TABLETOP VAPORIZER

(71) Applicant: Adam Montgomery, Phoenix, AZ (US)

(72) Inventor: Adam Montgomery, Phoenix, AZ (US)

( * ) Notice: Subject to any disclaimer, the term of this patent is extended or adjusted under 35 U.S.C. 154(b) by 151 days.

(21) Appl. No.: 14/989,138

(22) Filed: Jan. 6, 2016

(65) Prior Publication Data

US 2017/0188628 A1 Jul. 6, 2017

(51) Int. Cl.

*A24F 47/00* (2006.01)
*F22B 1/28* (2006.01)
*H05B 1/02* (2006.01)

(52) U.S. Cl.

CPC ..... *A24F 47/008* (2013.01); *F22B 1/284* (2013.01); *H05B 1/0297* (2013.01)

(58) Field of Classification Search

CPC .. A24F 11/00; A24F 1/32; A24F 25/02; A24F 47/008; A24F 13/26
USPC ..... 131/328, 329; 34/104
See application file for complete search history.

(56) References Cited

U.S. PATENT DOCUMENTS 2,483,993 A * 10/1949 Becker ..... C23G 3/00 122/234
6,761,164 B2 7/2004 Amirpour et al.
7,434,584 B2 * 10/2008 Steinberg ..... A24F 1/00 131/194
7,445,007 B2 11/2008 Balch et al.
7,475,685 B2 1/2009 Dietz et al.
7,622,140 B2 11/2009 Whittle et al.
7,624,734 B2 12/2009 Balch et al.
8,488,952 B2 7/2013 Landry
8,550,091 B2 * 10/2013 Yomtov ..... A24F 1/30 131/173
9,474,306 B2 * 10/2016 Tucker ..... H01C 17/00

* cited by examiner

*Primary Examiner* — Hien Vu

(74) *Attorney, Agent, or Firm* — Parsons & Goltry; Robert A. Parsons; Michael W. Goltry

(57) ABSTRACT

A vaporizer for thermally vaporizing solid or liquid carrier materials is taught. The vaporizer includes a support member, and an air heating assembly carried by the support member. The air heating assembly includes a radiating element having a central tubular member with an upper end wall defining a reservoir for liquid carrier materials and a lower end wall spaced apart from the upper end wall defining an air chamber therebetween. A chamber element is received about the radiating element to close the air chamber and direct airflow therethrough. A heating element is carried within the tubular member of the radiating element. A hand piece including a vaporization chamber is couplable to an exit aperture of the chamber element.

19 Claims, 6 Drawing Sheets

FIG. 1

FIG. 2

DITANIUM VAPORS

DITANIUM VAPORIZER

AVM-1000

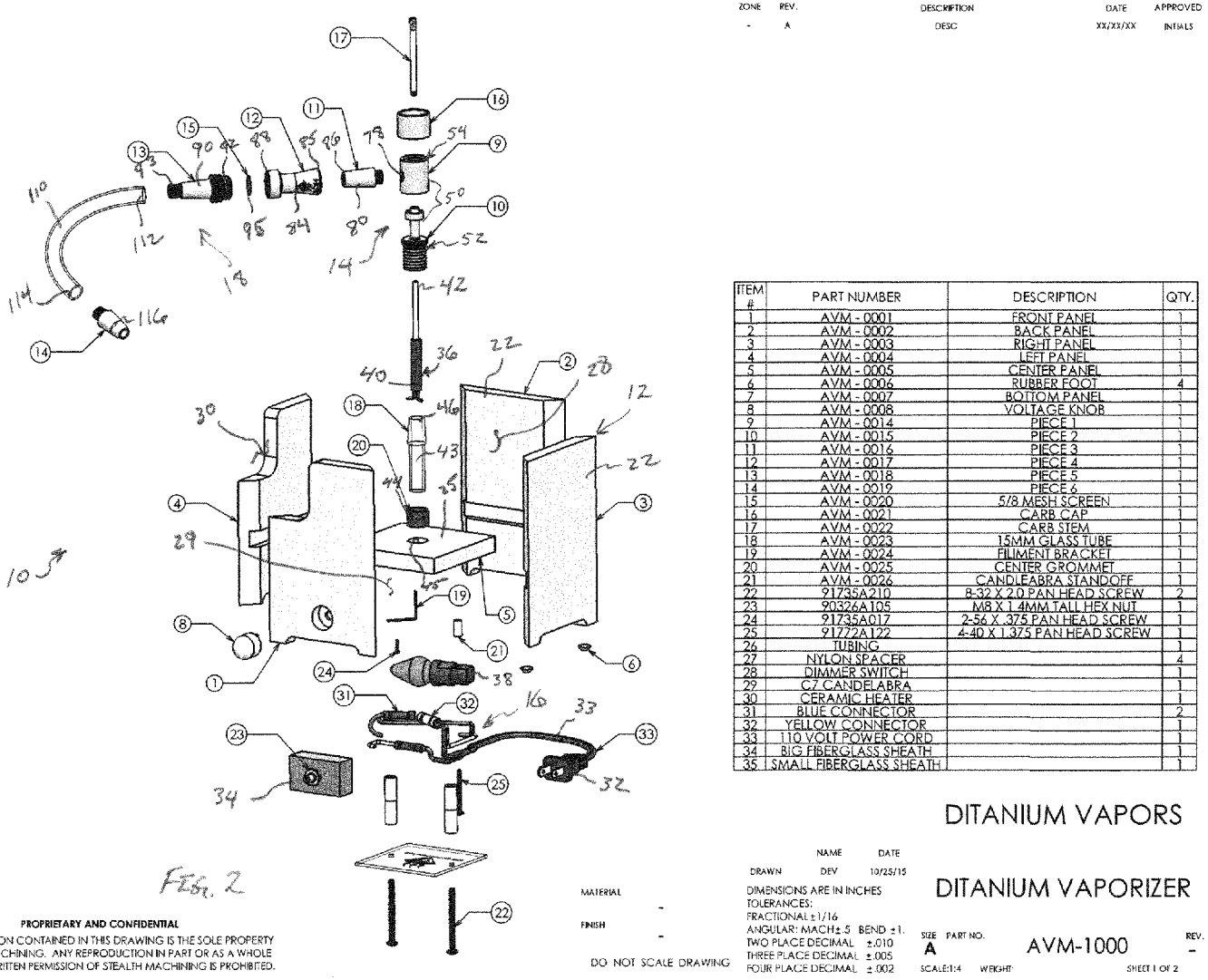

| ITEM # | PART NUMBER | DESCRIPTION | QTY. |
|---|---|---|---|
| 1 | AVM - 0001 | FRONT PANEL | 1 |
| 2 | AVM - 0002 | BACK PANEL | 1 |
| 3 | AVM - 0003 | RIGHT PANEL | 1 |
| 4 | AVM - 0004 | LEFT PANEL | 1 |
| 5 | AVM - 0005 | CENTER PANEL | 1 |
| 6 | AVM - 0006 | RUBBER FOOT | 4 |
| 7 | AVM - 0007 | BOTTOM PANEL | 1 |
| 8 | AVM - 0008 | VOLTAGE KNOB | 1 |
| 9 | AVM - 0014 | PIECE 1 | 1 |
| 10 | AVM - 0015 | PIECE 2 | 1 |
| 11 | AVM - 0016 | PIECE 3 | 1 |
| 12 | AVM - 0017 | PIECE 4 | 1 |
| 13 | AVM - 0018 | PIECE 5 | 1 |
| 14 | AVM - 0019 | PIECE 6 | 1 |
| 15 | AVM - 0020 | 5/8 MESH SCREEN | 1 |
| 16 | AVM - 0021 | CARB CAP | 1 |
| 17 | AVM - 0022 | CARB STEM | 1 |
| 18 | AVM - 0023 | 15MM GLASS TUBE | 1 |
| 19 | AVM - 0024 | FILMENT BRACKET | 1 |
| 20 | AVM - 0025 | CENTER GROMMET | 1 |
| 21 | AVM - 0026 | CANDLEABRA STANDOFF | 1 |
| 22 | 91735A210 | 8-32 X 2.0 PAN HEAD SCREW | 2 |
| 23 | 90326A105 | M8 X 1.4MM TALL HEX NUT | 1 |
| 24 | 91735A017 | 2-56 X .375 PAN HEAD SCREW | 1 |
| 25 | 91772A122 | 4-40 X 1.375 PAN HEAD SCREW | 1 |
| 26 | TUBING | | 1 |
| 27 | NYLON SPACER | | 4 |
| 28 | DIMMER SWITCH | | 1 |
| 29 | C7 CANDELABRA | | 1 |
| 30 | CERAMIC HEATER | | 1 |
| 31 | BLUE CONNECTOR | | 1 |
| 32 | YELLOW CONNECTOR | | 2 |
| 33 | 110 VOLT POWER CORD | | 1 |
| 34 | BIG FIBERGLASS SHEATH | | 1 |
| 35 | SMALL FIBERGLASS SHEATH | | 1 |

REVISIONS

| ZONE | REV. | DESCRIPTION | DATE | APPROVED |
|---|---|---|---|---|
| - | A | DESC | XX/XX/XX | INITIALS |

DITANIUM VAPORS

DITANIUM VAPORIZER

NAME DATE
DRAWN
DEV 10/25/15

DIMENSIONS ARE IN INCHES
TOLERANCES:
FRACTIONAL ± 1/16
ANGULAR: MACH ± .5 BEND ± 1.
TWO PLACE DECIMAL ± .010
THREE PLACE DECIMAL ± .005
FOUR PLACE DECIMAL ± .002

MATERIAL -
FINISH -
DO NOT SCALE DRAWING

SIZE A PART NO. AVM-1000 REV. -
SCALE: 1:4 WEIGHT SHEET 1 OF 2

FIG. 2

PROPRIETARY AND CONFIDENTIAL
THE INFORMATION CONTAINED IN THIS DRAWING IS THE SOLE PROPERTY OF STEALTH MACHINING. ANY REPRODUCTION IN PART OR AS A WHOLE WITHOUT THE WRITTEN PERMISSION OF STEALTH MACHINING IS PROHIBITED.

TABLETOP VAPORIZER

FIELD OF THE INVENTION

This invention relates to devices for vaporizing substances from carrier materials.

More particularly, the present invention relates to desktop vaporizers employing thermal vaporization.

BACKGROUND OF THE INVENTION

The drawing of substances into the lungs of an individual has long occurred for medical, religious and recreational reasons. Conventionally, drawing substances into the lungs has occurred primarily by the combustion of carrier materials to produce smoke, which is then inhaled into the lungs. This process has been used for a long time, and has been developed to include many devices to assist combustion and inhalation. While very effective, there are drawbacks to this process. Primarily, along with the substance desired, other products of the combustion process are also drawn into the lungs. These combustion substances can be detrimental to health and add unpleasantness to the process.

Another method of introducing substances into the lungs is by the use of vapor. Again, this process has been used for many years, and includes placing carrier materials into a container with water, and heating the water until it steams. This steam is a vapor which can carry volatile components of the carrier material and can be inhaled into the lungs. While eliminating combustion products, this process can be unwieldy and very inefficient.

Relatively recently, vaporizers have been developed using thermal elements to heat air passing through a carrier material. The heated air forms a vapor carrying desired active compounds and elements from the carrier material. Unfortunately, these devices are limited in the type of carrier material which can be used. Only solids can be vaporized in the conventional devices, greatly limiting their effectiveness. Additionally, controlled heating of the carrier material can be problematic, causing burning as opposed to vaporization It would be highly advantageous, therefore, to remedy the foregoing and other deficiencies inherent in the prior art.

An object of the present invention is to provide a new and improved tabletop vaporizer.

Another object of the present invention is to provide a vaporizer which can vaporize liquids and solids.

Yet another object of the present invention is to provide a vaporizer which has consistent heat control.

SUMMARY OF THE INVENTION

Briefly, to achieve the desired objects and advantages of the instant invention, provided is a vaporizer for thermally vaporizing solid or liquid carrier materials. The vaporizer includes a support member and an air heating assembly carried by the support member. The air heating assembly includes a radiating element and a chamber element. The radiating element includes a central tubular member with a lower end and an upper end, an upper end wall defining a reservoir for receiving a liquid carrier material extending from and encircling the upper end and a lower end wall extending radially from the lower end and spaced apart from the upper end wall, the upper end wall and the lower end wall defining an air chamber therebetween. The chamber element is received about the radiating element and has a lower end coupled to the lower end wall and an upper end encircling and engaging the upper end wall. The chamber element encloses the air chamber and has at least one aperture extending through the upper end thereof in gaseous communication with the air chamber, and an exit aperture extending through the chamber element perpendicular to the central tubular member of the radiating element and in communication with the air chamber. A heating element is carried within the tubular member of the radiating element, and a hand piece is couplable to the exit aperture of the chamber element.

The support member is substantially parallel to a supporting surface supporting the vaporizer and carried by a housing. The hand piece includes a vaporizing chamber assembly couplable to the exit aperture of the chamber element with a coupling element, and a flexible tubing extending from the vaporizing chamber assembly and terminating in a mouthpiece. The vaporizing chamber assembly includes a receptacle having a receiving end for removably receiving the coupling member and an opposing coupling end. A screen holder has a screen end and a tube end, the opposing coupling end of the receptacle removably coupled to the screen end. A screen is carried by screen end and retained in position by the receptacle.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 2 is an exploded view of the tabletop vaporizer of FIG. 1;

DETAILED DESCRIPTION OF THE PREFERRED EMBODIMENTS

Figure 1:
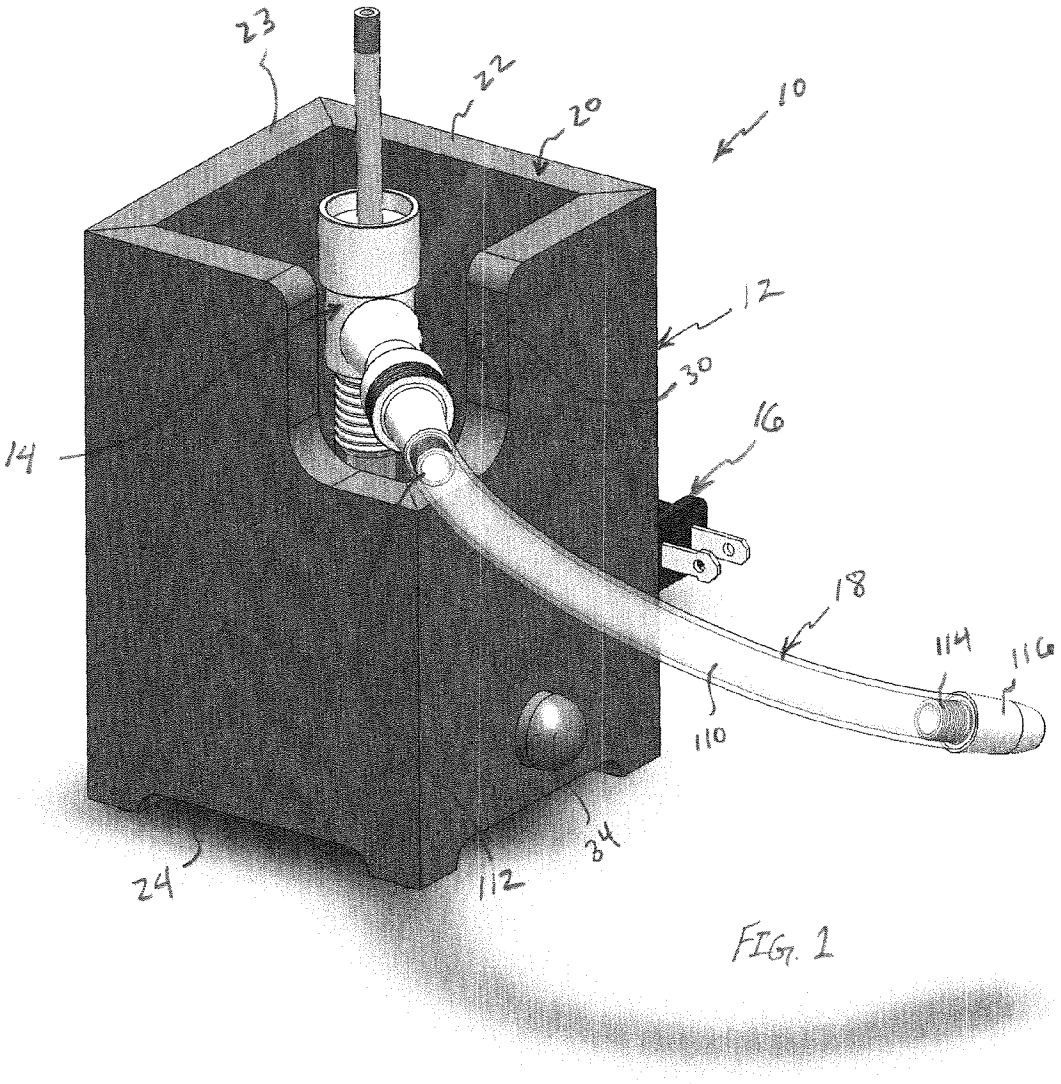
FIG. 1 is a perspective view of a tabletop vaporizer according to the present invention.

Turning now to the drawings in which like reference characters indicate corresponding elements throughout the several views, attention is first directed to FIGS. 1 and 2 which illustrate a tabletop vaporizer generally designated 10, for vaporizing the active ingredients of plant material, commonly cannabis, tobacco, or other herbs or blends for the purpose of inhalation, as well as essential oils or liquids containing active components, herein referred to as carrier material. It will also be understood that pure chemicals when mixed with plant material can also be used as a carrier material. Vaporizer 10 includes a housing 12 supporting a vaporizing mechanism 14 controlled by an electrical system 16 on a generally flat surface such as a table, desk, floor and the like. For purposes of this description, the terms "upper" and "lower" are used to designate the orientation of elements away from the surface and toward the surface respectively. Vapor is generated through a hand piece 18 removably coupled to the vaporizing mechanism 14.

Housing 12 includes a perimeter wall 20 defining an interior volume and having an open top end 23 and a bottom end 24. Perimeter wall 20 can include a plurality of sidewall elements 22 forming a polygon such as a square, as employed in the preferred embodiment, or a single sidewall forming a circle, oval and the like. A support member 25 extends from perimeter wall 20 across the interior volume intermediate top end 23 and bottom end 24, dividing interior volume into a top space 28 and a bottom space 29. Support member 25 is generally parallel to the surface upon which table top vaporizer 10 sits. Vaporizing mechanism 14 is supported by support member 25 and contained primarily within top space 28. Vaporizing mechanism 14 is accessible by a user through open top end 23 and an access gap 30, formed in perimeter wall 20 in communication with top space 28. Electrical system 16 is primarily carried within bottom space 29 for esthetic and safety reasons.

Figure 3:
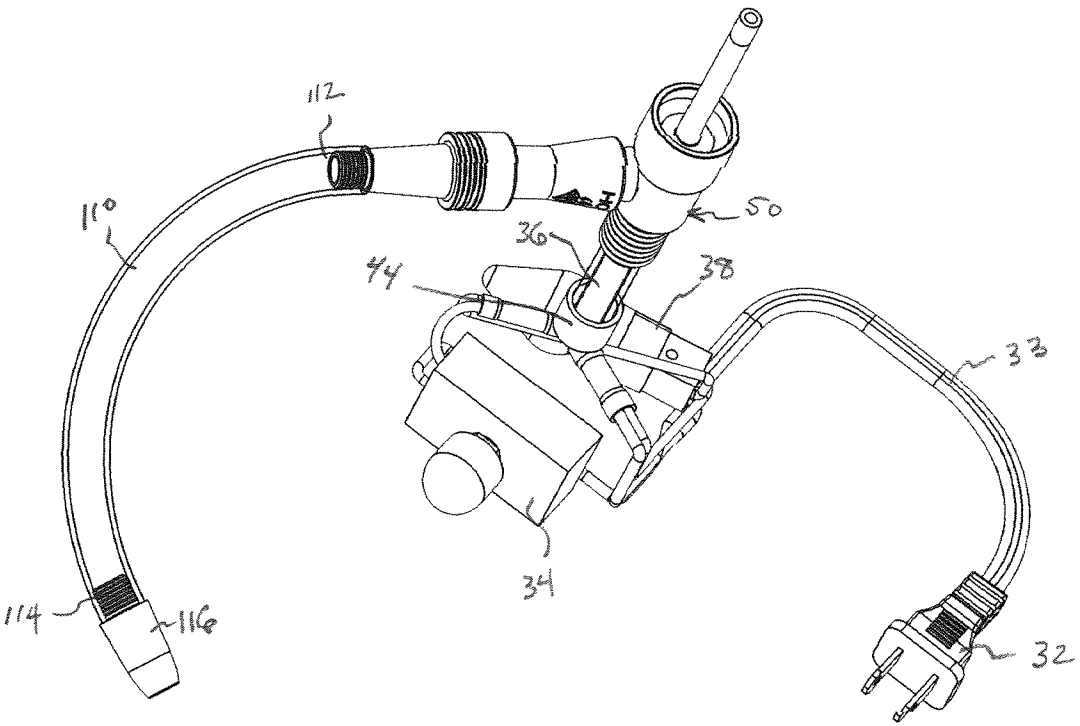
FIG. 3 is a perspective view of the vaporizer with the housing removed.

Referring now to FIG. 3, housing 12 has been removed to provide an unobstructed view of vaporizing mechanism 14 and electrical system 16. Electrical system 16 includes a power source, which in the preferred embodiment is a power plug 32 and cord 33. Power plug 32 can be plugged into any power socket desired, to provide power to vaporizing mechanism 14. It will be understood that while the preferred power source is a power plug 32 plugged, for example, into a wall socket, the power source can be a battery and the like. Cord 33 is coupled through a dimmer assembly 34, power regulator such as a rheostat or the like to a heating element 36 to allow controlled heat production. An indicator light 38 is preferably coupled between dimmer assembly 34 and heating element 36 to indicate the level of power supplied by dimmer assembly 34 and thus, the level of heat being generated by heating element 36. Dimmer assembly 34 is preferably adjustable from an off position.

Figure 4:
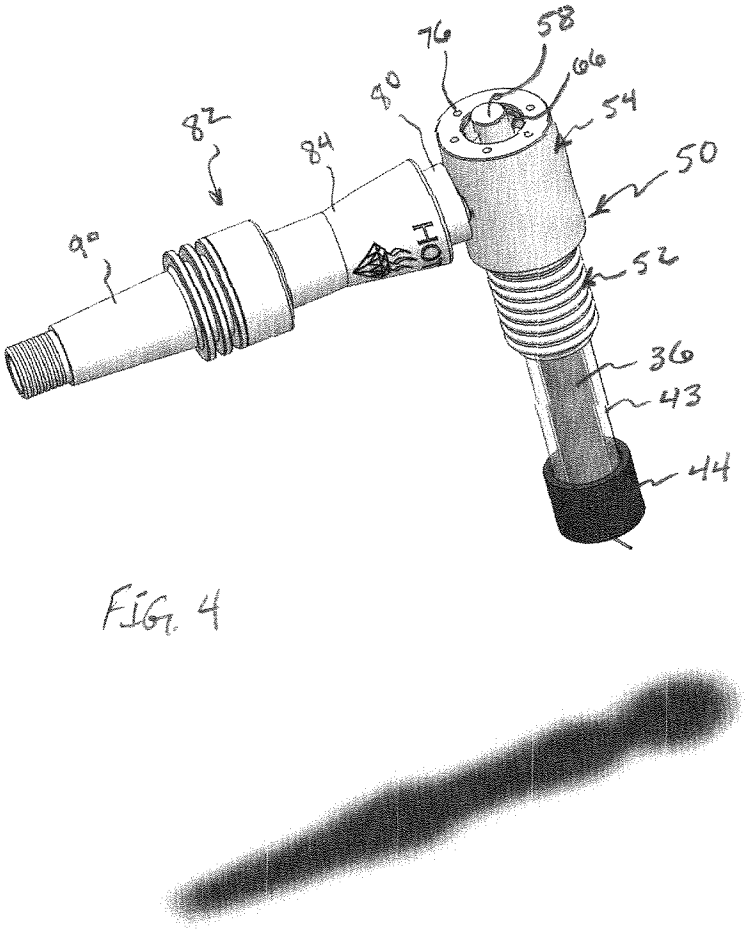
FIG. 4 is a perspective view of the vaporizing mechanism with attached vaporizing chamber.

Referring to FIGS. 2 and 3, with additional reference to FIG. 4, vaporizing mechanism 14 includes a heating element 36 having a lower end 40 with an insulating layer, and an exposed upper end 42. Heating element 36 is preferably a ceramic heating element, but can be other types such as a heating coil, resistance coil and the like. Lower end 42 is enclosed within a shield 43 preferably formed of glass which is non-heat conducting and helps protect lower end 42 from unintentional contact. A grommet 44 encircles a lower end of shield 43 and is received in an aperture 45 formed in support member 25. Grommet 44 securely retains shield 43 and heating element 36 to support member 25 while insulating them therefrom, to prevent damage from heat. Grommet 44 is preferably formed from silicon or the like. An upper end of shield 43 is formed with a taper 46 for purposes which will be described presently.

Figure 5:
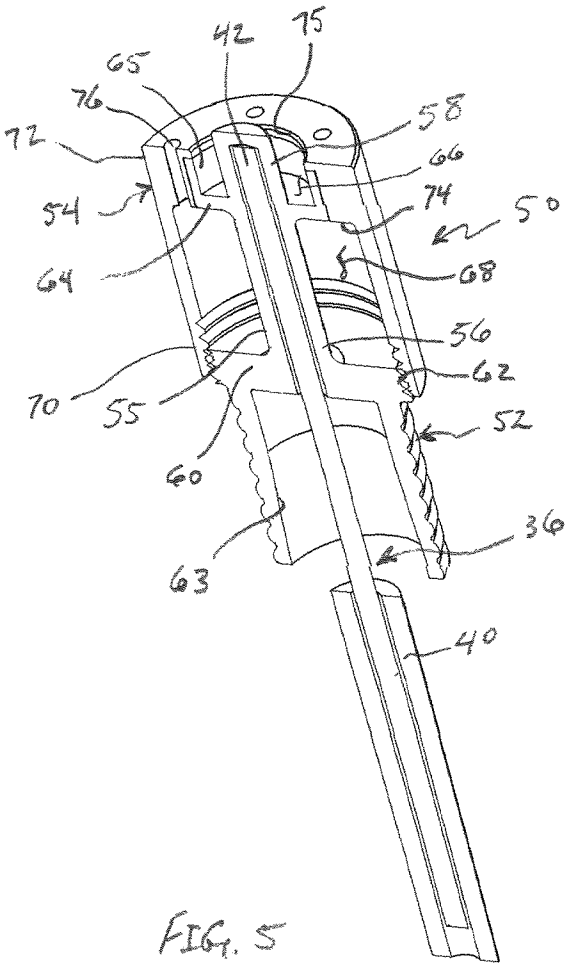
FIG. 5 is a sectional view of the vaporizer mechanism.

Referring additionally to FIG. 5, upper end 42 of heating element 36 is received in an air heating assembly 50. Air heating assembly 50 includes a radiating element 52 and a chamber element 54 coupled thereto. With additional reference to FIG. 5, radiating element 52 includes a central tubular member 55 having a lower end 56 and an upper end 58. A lower annular end wall 60 extends radially outwardly from lower end 56 and terminates in an engagement surface 62. A tubular structure 63 extends downwardly from the periphery of lower annular end wall 60 to receive and engage taper 46 of shield 43. An upper annular end wall 64 extends radially outwardly from proximate upper end 58 and terminates in a perpendicular sidewall 65 encircling and spaced apart from upper end 58. Sidewall 65 and upper annular end wall 64 define a reservoir 66 at upper end 58. Lower annular end wall 60 and upper annular end wall 64 are spaced apart, defining an air chamber 68 therebetween, closed by chamber element 54. Chamber element 54 is tubular and includes an engagement end 70 which is coupled to engagement surface 62 of radiating element 52. In the preferred embodiment, chamber element 54 includes threads on the outer surface of engagement end 70 which mate with complemental threads formed on engagement surface 62 to form a tight and removable coupling. Chamber element 54 also includes an upper end 72 which is thickened to form an interior shoulder 74 corresponding to upper annular end wall 64. Upper end 72 terminates in a flange 75 radially inwardly directed. When in engagement with radiating element 52, chamber element 54 encloses air chamber 68. A plurality of air feed apertures 76 extend longitudinally through thickened upper end 72 in gaseous communication with air chamber 68. Thus, air enters through upper end 72 and flows into the air chamber for heating.

Figure 6:
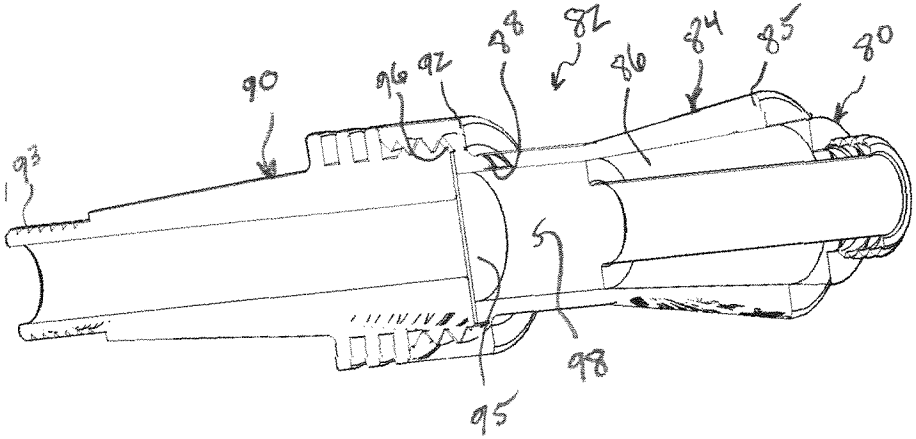
FIG. 6 is a sectional view of the vaporizing chamber.

Still referring to FIGS. 2 and 3, hand piece 18 is coupled to air heating assembly 50. Air heating assembly 50 includes an aperture 78 extending through chamber element 54 in communication with air chamber 68. Air moves downward through air feed apertures 76, is heated within air chamber 68 and exits through aperture 78. A coupling member 80 is attached to aperture 78 to removably couple a vaporizing chamber assembly 82 of hand piece 18 to air heating assembly 50. With additional reference to FIG. 6, vaporizing chamber assembly 82 includes a receptacle 84 having a receiving end 85 for removably receiving a tapered end 86 of coupling member 80 and a threaded end 88. A screen holder 90 having a screen end 92 and a tube end 93, is coupled to receptacle 84. Threaded end 88 of receptacle 84 is threadably coupled to screen end 92. A screen 95 is carried by an interior shoulder 96 of screen end 92 and held in place by receptacle 84 when threaded end 88 is coupled to screen end 92. While vaporizing chamber assembly 82 is preferably formed with two parts removably coupled to allow replacement or cleaning of screen 95, it will be understood that vaporizing chamber assembly 82 can be formed in a single element with screen 95 inserted through receiving end 85. A vaporization chamber 98 is defined by threaded end 88 of receptacle 84 between screen 95 and tapered end 86. An airflow path extends from aperture 78 through coupling member 80, receptacle 84 and Screen holder 90, passing though vaporization chamber 98 and screen 95.

Referring back to FIGS. 1, 2 and 3, hand piece 18 further includes a flexible tubing 110 having an end 112 coupled to tube end 93 of screen holder 90 and an end 114 coupled to a mouthpiece 116. Flexible tubing 110 is of sufficient length to provide convenient reach from vaporizing chamber assembly 82 to a users mouth.

Air heating assembly 50 is preferably fabricated of grade 2 titanium. This material is suitably strong to enable engagement of the various structures and coupling members, as well as being sufficiently thermally conductive to transfer heat from heating element 36 to air chamber 68 for heating air passing therethrough. It also has a low aluminum content to reduce or eliminate any aluminum in the vapor. It has been determined that steel and the like are not as effective conducting and maintaining the heat generated. Additionally, vaporization chamber assembly 82 is also preferably formed of titanium. However, vaporization chamber assembly 82 can also be formed of other materials such as glass, steel and the like. Grade 2 titanium is preferred because it contains little to no Aluminum and Vanadium. Grade 5 titanium is the most common but contains 4-6% of each Aluminum and Vanadium. When heated the melting points for Aluminum and Vanadium are much lower than Titanium. These elements can be very bad if inhaled, therefore Titanium grade 1, or 2 are used for safety concerns. Titanium is superior to glass, quartz, and ceramic because of heating and thermal retention properties, as well as durability.

In operation, hand piece 18 is disconnected from coupling member 80. A carrier material is inserted through receiver end 85 into vaporization chamber 98, against screen 95. In this case, a solid carrier material is employed, such as plant materials, herbs, natural products, and the like, that preferably have high moisture and oil contents. Collectively, these substances will be referred to as carriers or herbs, which when heated emit vapor containing medicinal and/or therapeutic qualities. Hand piece 18 is then reconnected to coupling member 80 in preparation for use. Connection of hand piece 18 is easily accomplished through access gap 30. Coupling member 80 extends substantially horizontally from air heating assembly 50, substantially parallel to support member 36 and the surface upon which vaporizer 10 rests. The horizontal orientation of vaporization chamber assembly 82 prevents spilling of carrier material when attaching hand piece 18. Heating element 36 is powered to the desired temperature and air is drawn from mouth piece 116. Drawing air through mouthpiece 116 results in air being drawn through air heating assembly 50 where it enters air chamber 68 and is heated before passing into vaporization chamber assembly 82. In vaporization chamber assembly 82 the heated air vaporizes the active components in the carrier material allowing them to be drawn into a user's lungs through mouth piece 116. Depending on the carrier materials used, the temperature of the vaporizing air can be adjusted by using dimmer assembly 34. It is desirous that burning of carrier materials be avoided.

In another method of operation, a liquid carrier material is employed. In this case, the hand piece 18 does not need to be uncoupled, rather, the liquid carrier material is placed in reservoir 66 at distal end 58 of radiating element 52. The liquid carrier material is heated by heating element 36 to a vaporization point. Air drawn through the device take up the vapor and draw is through apertures 76 into air chamber 68 and then into hand piece 18. In this manner, the present vaporizer can vaporize both liquid and solid carrier materials.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A vaporizer for thermally vaporizing solid or liquid carrier materials comprising:

a support member;

an air heating assembly carried by the support member, the air heating assembly comprising:

a radiating element including a central tubular member with a lower end and an upper end, an upper end wall defining a reservoir for receiving a liquid carrier extending from and encircling the upper end and a lower end wall extending radially from the lower end and spaced apart from the upper end wall, the upper end wall and the lower end wall defining an air chamber therebetween; and a chamber element received about the radiating element and having a lower end coupled to the lower end wall and an upper end encircling and engaging the upper end wall, the chamber element enclosing the air chamber and having at least one aperture extending through the upper end thereof in gaseous communication with the air chamber, and an exit aperture extending through the chamber element perpendicular to the central tubular member of the radiating element and in communication with the air chamber;

a heating element carried within the central tubular member of the radiating element; and a hand piece couplable to the exit aperture of the chamber element with a coupling element.

2. The vaporizer as claimed in claim 1 wherein the support member is substantially parallel to a supporting surface supporting the vaporizer.

3. The vaporizer as claimed in claim 1 wherein the hand piece comprises:

a vaporizing chamber assembly for receiving a solid carrier material couplable to the exit aperture of the chamber element with a coupling element; and a flexible tubing extending from the vaporizing chamber assembly and terminating in a mouthpiece.

4. The vaporizer as claimed in claim 3 wherein the vaporizing chamber assembly further comprises:

a receptacle having a receiving end for removably receiving the coupling member and an opposing coupling end;

a screen holder having a screen end and a tube end, the opposing coupling end of the receptacle removably coupled to the screen end; and a screen carried by screen end and retained in position by the receptacle.

5. The vaporizer as claimed in claim 4 wherein the receptacle of the vaporizing chamber assembly defines a vaporizing chamber for receiving the solid carrier material.

6. The vaporizer as claimed in claim 1 wherein the air heating assembly is formed of grade 2 titanium.

7. The vaporizer as claimed in claim 2 further comprising:

a housing carrying the support member;

an access gap formed through the housing to provide access to the air heating assembly.

8. A vaporizer for thermally vaporizing solid or liquid carrier materials comprising:

a housing including a perimeter wall defining an interior volume and having an open top end and a bottom end, the interior volume divided in to a top space and a bottom space by a support member extending from the perimeter wall across the interior volume intermediate the top end and the bottom end, the support member being substantially parallel to a supporting surface supporting the vaporizer;

an air heating assembly carried by the support member, the air heating assembly comprising:

radiating element including a central tubular member with a lower end and an upper end, an upper end wall defining a reservoir for receiving liquid carrier material extending from and encircling the upper end and a lower end wall extending radially from the lower end and spaced apart from the upper end wall, the upper end wall and the lower end wall defining an air chamber therebetween; and a chamber element received about the radiating element and having a lower end coupled to the lower end wall and an upper end encircling and engaging the upper end wall, the chamber element enclosing the air chamber and having at least one aperture extending through the upper end thereof in gaseous communication with the air chamber, and an exit aperture extending through the chamber element perpendicular to the central tubular member of the radiating element and in communication with the air chamber;

a heating element carried within the central tubular member of the radiating element; and a hand piece couplable to the exit aperture of the chamber element with a coupling element.

9. The vaporizer as claimed in claim 8 wherein the hand piece comprises:

a vaporizing chamber assembly couplable to the exit aperture of the chamber element with a coupling element; and a flexible tubing extending from the vaporizing chamber assembly and terminating in a mouthpiece.

10. The vaporizer as claimed in claim 9 wherein the vaporizing chamber assembly further comprises:

a receptacle having a receiving end for removably receiving the coupling member and an opposing coupling end;

a screen holder having a screen end and a tube end, the opposing coupling end of the receptacle removably coupled to the screen end; and a screen carried by screen end and retained in position by the receptacle.

11. The vaporizer as claimed in claim 10 wherein the receptacle of the vaporizing chamber assembly defines a vaporizing chamber.

12. The vaporizer as claimed in claim 10 wherein the vaporizing chamber assembly extends generally perpendicularly from the air heating assembly and substantially parallel to the supporting surface supporting the vaporizer.

13. The vaporizer as claimed in claim 8 wherein the air heating assembly is formed of grade 2 titanium.

14. The vaporizer mechanism for thermally vaporizing solid and liquid carrier materials comprising:

a radiating element including a central tubular member with a lower end and an upper end, an upper end wall defining a reservoir for receiving liquid carrier material extending from and encircling the upper end and a lower end wall extending radially from the lower end and spaced apart from the upper end wall, the upper end wall and the lower end wall defining an air chamber therebetween;

a chamber element received about the radiating element and having a lower end coupled to the lower end wall and an upper end encircling and engaging the upper end wall, the chamber element enclosing the air chamber and having at least one aperture extending through the upper end thereof in gaseous communication with the air chamber, and an exit aperture extending through the chamber element perpendicular to the central tubular member of the radiating element and in communication with the air chamber;

a heating element carried within the central tubular member of the radiating element; and a vaporizing chamber assembly for receiving solid carrier material couplable to the exit aperture of the chamber element with a coupling element.

15. The vaporizer as claimed in claim 14 further including a support member supporting the radiating element in a vertical orientation on a supporting surface supporting the vaporizer.

16. The vaporizer as claimed in claim 14 further comprising:

a flexible tubing extending from the vaporizing chamber assembly; and the flexible tubing terminating in a mouthpiece.

17. The vaporizer as claimed in claim 14 wherein the vaporizing chamber assembly further comprises:

a receptacle having a receiving end for removably receiving the coupling member and an opposing coupling end;

a screen holder having a screen end and a tube end, the opposing coupling end of the receptacle removably coupled to the screen end; and a screen carried by screen end and retained in position by the receptacle.

18. The vaporizer as claimed in claim 14 wherein the radiating element and the chamber element are formed of grade 2 titanium.

19. The vaporizer as claimed in claim 15 further comprising:

a housing carrying the support member;

an access gap formed through the housing to provide access to the air heating assembly.

* * * * *